United States Patent [19]

Blind et al.

[11] 4,213,643

[45] Jul. 22, 1980

[54] KNEE LEVER LOCK FOR AIR FILTER COVERS AND THE LIKE

[75] Inventors: Karl Blind, Erdmannhausen; Arthur Klotz, Neckargröningen, both of Fed. Rep. of Germany

[73] Assignee: Filterwerk Mann & Hummel GmbH, Ludwigsburg, Fed. Rep. of Germany

[21] Appl. No.: 4,220

[22] Filed: Jan. 17, 1979

[30] Foreign Application Priority Data

Jan. 18, 1978 [DE] Fed. Rep. of Germany ..... 2802006

[51] Int. Cl.[2] ..... E05B 5/04

[52] U.S. Cl. ..... 292/247; 292/DIG. 49

[58] Field of Search ..... 292/247, 113, DIG. 49, 292/DIG. 31, 256–267

[56] References Cited

U.S. PATENT DOCUMENTS 572,257 12/1896 Heinemann ..... 292/247 X 899,084 9/1908 Thoits et al. ..... 292/247

FOREIGN PATENT DOCUMENTS 708385 5/1954 United Kingdom ..... 292/247

*Primary Examiner*—Richard E. Moore

*Attorney, Agent, or Firm*—Joseph A. Geiger

[57] ABSTRACT

A quickly releasable clamping lock of the knee lever type, usable to clamp a filter cover to the filter housing of an engine air intake filter, the lock assembly comprising a curved hook member whose one extremity engages the filter cover and whose other extremity is pivotably attached to a knee lever, the latter in turn, being pivotable about a pivot anchor which, like the hook member and the knee lever, is a U-shaped wire part with angled-off anchoring trunnions engaging transverse apertures in the wall of the filter housing. The pivot connection between the pivot anchor and the knee lever is formed by wire loops in the leg portions of the pivot anchor and by angled-off pivot trunnions on the wire extremities of the knee lever. Alternatively, the pivot anchor may be a U-shaped stamping with angled-off lugs in the place of the anchoring trunnions and bores in the place of the wire loops.

6 Claims, 6 Drawing Figures

KNEE LEVER LOCK FOR AIR FILTER COVERS AND THE LIKE

BACKGROUND OF THE INVENTION

1. Field of the Invention

The present invention relates to quick-release clamping locks of the knuckle action or knee lever type, and, more particularly, to a knee lever lock of the type which is usable in connection with automotive air filters, for the clamping attachment of a filter cover to a filter housing.

2. Description of the Prior Art

Quick release knee lever locks using a knee lever and an attached hook member which, through the pivoting action of the knee lever, is pulled into clamping engagement, have become widely accepted as clamping locks for air intake filters, particularly for carburetor-mounted shallow air intake filters, where a substantially flat filter cover of large diameter is clamped against the rim of a pan-shaped filter housing. Usually, four or five of these knee lever locks are arranged at regular intervals on the periphery of the filter housing.

Known knee lever locks of the type under consideration commonly consist of two principal parts: a curved, resiliently extendable hook member and a knee lever which is pivotably attached to the filter housing. The hook extremity of the hook member engages a bead or groove on the periphery of the filter cover, and its opposite extremity is pivotably attached to the knee lever. This pivot attachment and the fixed pivot of the knee lever on the filter housing are so arranged that, when the knee lever is pivoted downwardly against the filter housing wall, it moves the hook member pivot beyond the dead center point with respect to the force line which links the hook extremity and the fixed pivot. In this position, the pull of the hook member urges the knee lever against the filter housing, thereby holding the lock in its closed position. The curved hook member, acting as a spring, thus produces a reliable clamping action, unaffected by vibration. This type of knee lever lock is simple and inexpensive. It is easy to operate, and, in most cases, lends itself well for mass production.

One such knee lever lock is disclosed in German Gebrauchsmuster (Utility Model) No. 1,661,181. This lock is used to clamp an angularly resettable dome-shaped filter cover against a pot-shaped filter housing. The disclosed lock assembly consists of a curved hook member whose hook extremity is formed by the yoke of a U-shaped wire part and whose inwardly bent extremities form pivot trunnions. The latter engage matching pivot holes in a knee lever in the form of a sheet metal stamping. The fixed pivot for the knee lever is provided as part of a pivot support member. This member is likewise a sheet metal stamping of U-shaped outline which is spot-welded to the wall of the filter housing. The highly stressed spot weld represents a comparatively expensive operation, requiring special tooling and equipment. Furthermore, such a spot welding operation represents difficulties in terms of quality control, under mass production conditions.

Another version of a prior art knee lever lock is suggested in German Gebrauchsmuster (Utility Model) No. 1,769,842. This unit is designed for use on a filter housing of injection-molded plastic for an oil bath air cleaner, suggesting the arrangement of the fixed pivot supports for the knee levers in the form of integrally molded radial extensions on the housing wall, near the rim of the latter. Obviously, this approach is not usable in connection with a filter housing of sheet metal.

A further prior art knee lever lock is disclosed in German Gebrauchsmuster (Utility Model) No. 73 07 369. This disclosure suggests a knee lever lock on a filter housing of sheet metal, where the previously required pivot support member has been eliminated, and the pivot apertures for the knee lever are formed in the wall of the filter housing itself. But, because of the necessity for the fixed pivot point to be located radially outside the force line between the clamping point of the hook member and its pivot point on the knee lever in the clamped position, it becomes necessary to either extend the wall of the filter housing radially outwardly beyond its normal rim diameter, in the form of lug-like pivot extensions of the housing wall, or to provide appropriate inward depressions in the wall of the filter housing below the knee lever pivot point, for a pivoting movement of the knee lever beyond the dead-center position of the hook member.

While the arrangement of lug-like extensions of the housing wall is costly in terms of material requirements as well as tooling, the arrangement of depressions in the filter housing wall is not only similarly costly, but is also in conflict with the need for a cylindrical filter housing with optimal air flow conditions. On the other hand, the additional space which is required for this type of knee lever lock is frequently not available.

SUMMARY OF THE INVENTION

Underlying the present invention is the objective of providing an improved and less expensive knee lever lock which, while being usable as a quick-release cover clamp in a variety of applications, offers particular advantages for automotive air intake filters of the type which use a shallow cylindrical filter housing of large diameter.

The present invention proposes to attain this objective by suggesting a knee lever lock which includes, in addition to the conventional hook member and knee lever, a pivot anchor as a third part of the lock assembly, the pivot anchor being designed for attachment on the outside wall of the filter housing in a simple snap action.

The three parts of the proposed knee lever lock are preferably pre-assembled and stocked as a lock unit. A number of these units are later attached to the filter assembly by simply snaping the pivot anchor into place with an assembly tool. The previously required welding operation is no longer necessary. And, although the lock assembly is attached to an aperture in the wall of the filter housing, the latter need not have a special lug extension for the knee lever pivot and/or a wall depression for the closed position of the knee lever. The filter housing wall, accordingly, can remain cylindrical, with a conventional rim flange, the attachment of the pivot anchor requiring only a simple transverse aperture formation in the cylindrical portion of the housing wall.

The use of a pivot anchor in the form of a third member makes it possible to place the knee lever pivot point far enough from the wall of the filter housing, so that the knee lever can take the form of a simple U-shaped wire part. The correct attachment of the pivot anchor to the housing wall is easily verifiable through visual inspection. It is also possible to design the pivot anchor in such a way that it will undergo a certain amount of resilient deformation during the clamping action, so that the lock assembly is capable of sustaining a greater total clamping deformation than would be the case with a welded rigid pivot support member, or with a knee lever which is pivoted on a protruding portion of the filter housing itself.

Lastly, the proposed novel pivot anchor is not subject to fatigue failure, as can be the case with a spot-welded pivot support member. Replacement of the pivot anchor, should it become necessary, requires only very simple tools and minimal skill.

In a preferred embodiment of the invention, all three component parts of the knee lever lock assembly are wire parts of U-shaped, symmetrical outline. The two pivot connections between the hook member and the knee lever, and between the knee lever and the pivot anchor, are in the form of wire loops in the leg portions of one member which cooperate with angled-off, aligned pivot trunnions of the other member. Thus, the proposed novel pivot anchor has wire loops which determine the location of the knee lever pivot axis. The pivot anchor also has angled-off, aligned trunnions, like the pivot trunnions of the hook member and knee lever, but these trunnions serve as anchoring elements, engaging transverse wall apertures in the filter housing wall.

In another preferred embodiment of the invention, the pivot anchor is in the form of a sheet metal stamping of U-shaped outline, the leg portions of the stamping having pivot bores for the location of the knee lever pivot axis. Angled-off anchoring lugs on the leg portions engage shallow transverse wall apertures in the filter housing.

Both types of pivot anchor are attached to the filter housing wall in a simple snap-action assembly operation. This type of weld-free attachment of the knee lever lock unit to the filter housing is particularly advantageous in connection with filter housings which are made of deep-drawn aluminum sheet metal.

BRIEF DESCRIPTION OF THE DRAWINGS

Further special features and advantages of the invention will become apparent from the description following below, when taken together with the accompanying drawing which illustrates, by way of example, an embodiment of the invention which is represented in the various figures as follows.

DESCRIPTION OF THE PREFERRED EMBODIMENTS

Figure 1:
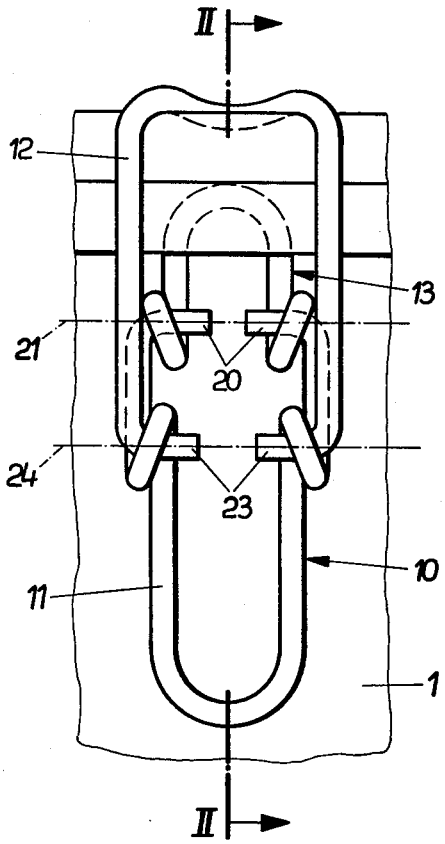
FIG. 1 shows a portion of an air filter assembly, as seen from the side, with a knee lever lock assembly embodying the present invention.
Figure 2:
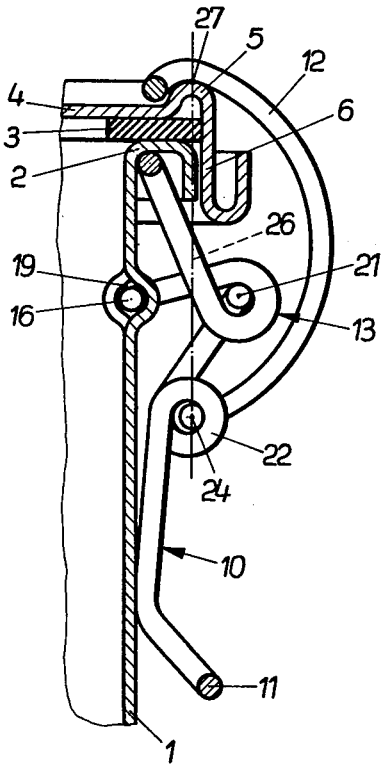
FIG. 2 is a transverse cross section through the assembly of FIG. 1, taken along line II—II thereof.

The knee lever lock of the present invention is illustrated in FIGS. 1 and 2 of the drawing, where the lock unit is shown in its closed or clamped position. At 1 is shown the cylindrical side wall of the filter housing which has on its upper end a conventional crimped housing rim in the form of an inverted U-shaped flange. Seated on the housing rim 2 is a flat cover gasket 3 and a housing cover 4. The latter has an upwardly protruding peripheral bead 5 and a centering collar 6 which reaches over the housing rim 2.

The knee lever lock unit 10 consists of a knee lever 11, a hook member 12, and a pivot anchor 13. All three components are wire parts, and all have a U-shaped symmetrical outline.

Figure 3:
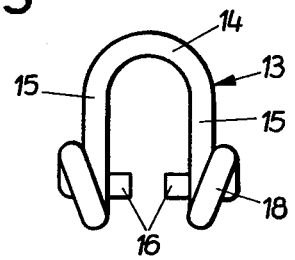
FIG. 3 shows separately the pivot anchor of the lock assembly of FIGS. 1 and 2.
Figure 4:
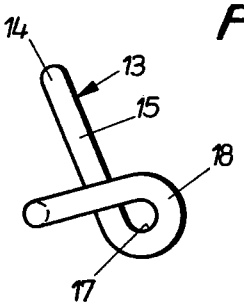
FIG. 4 shows the pivot anchor of FIG. 3 in a corresponding lateral view.

The pivot anchor of the lock assembly, shown separately in FIGS. 3 and 4, has a semi-circular yoke portion 14 and two parallel leg portions 15 forming pivot loops 18, for pivot apertures 17. The rearwardly extending extremities of the leg portions 15 are angled off into aligned anchoring trunnions 16 which extend in parallel alignment with the pivot apertures 17 for the knee lever 11.

FIG. 2 shows how the anchoring trunnions 16 of the pivot anchor 13 engage a matching transverse wall aperture 19 of the filter housing wall 1, the wall aperture 19 being formed by two circumferentially spaced vertical incisions in the housing wall, an outwardly deformed intermediate wall portion and correspondingly inwardly deformed wall portions opposite the two incisions. In order to attach the pivot anchor 13 to the housing wall 1, its anchoring trunnions 16 are spread apart a distance corresponding to the spacing of the wall incisions, for lateral insertion of the trunnions 16 into the transverse wall aperture 19. After insertion, the leg portions 15 of the pivot anchor are bent together. As can be seen in FIG. 2, the yoke portion 14 of the pivot anchor is engaged in the U-shape of the housing rim 2, when the anchoring trunnions 16 are engaged in the wall aperture 19, so that the pivot anchor 13 has a firm three-point or four-point support.

The pivot anchor 13 of FIGS. 3 and 4 has pivot trunnions 16 which are oriented inwardly, i.e. against each other. It should be understood that, while this is the preferred shape, a similar pivot anchor with outwardly oriented pivot trunnions could also be used, in which case the transverse wall aperture 19 in the filter housing wall would have to have the wall portion between the vertical incisions deformed inwardly and the wall portions beyond the incisions deformed outwardly.

The knee lever 11 is likewise a wire part, having a generally U-shaped, symmetrical outline, the two leg portions forming aligned inwardly pointing pivot trunnions 20 which engage the pivot apertures 177 of the pivot anchor 13. The latter thus form a horizontal pivot axis 21 about which the knee lever 11 is pivotable between the closed lock position of the drawing and an open position which is reached after a pivoting movement of the knee lever 11 away from the filter housing 1.

Like the pivot anchor 13, the knee lever 11 has loops 22 in its leg portions. The loops 22 form a horizontal pivot axis 24, in parallel alignment with the knee lever pivot axis 21, and spaced a distance away from the latter. In the apertures of the knee lever loops 22 are engaged the trunnions 23 of the hook member 12, so that the lower extremity of the hook member 12 is articulated on the knee lever 11, at the axis 24 which, in turn, swings about the fixed pivot axis 21.

The curved hook member 12, like the two previously described component parts of the lock unit, is a U-shaped, symmetrical wire part. In its yoke portion, opposite the trunnions 24, the hook member 12 has a hook formation which reaches over the peripheral bead 5 of the housing cover 4. And, because the lateral outline (FIG. 2) of the hook member 12 is curved, the hook member is resiliently extendable between its pivot connection with the knee lever 11, at the pivot axis 24, and its pressure point 27 on the peripheral bead 5. This longitudinal deformability of the hook member 12 gives the latter spring characteristics, assuring a reliable clamping effect between the filter cover 4 and the housing rim 2.

Figure 5:
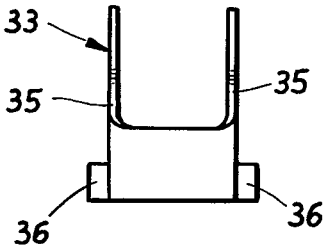
FIG. 5 shows separately an alternative version of a pivot anchor, usable in the place of the pivot anchor of FIG. 3.
Figure 6:
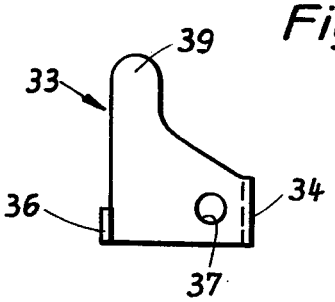
FIG. 6 shows the pivot anchor of FIG. 5 in a corresponding lateral view.

In FIGS. 5 and 6 is shown a different pivot anchor 33 which is usable in the place of the wire pivot anchor 13 of FIGS. 3 and 4. The pivot anchor 33 is in the form of a U-shaped sheet metal stamping, having a yoke portion 34 which forms a link between the two parallel leg portions 35. The latter have a generally triangular outline, with lug-like extremities 39 taking the place of the yoke portion 14 of the wire pivot anchor 13, inside the groove of the housing rim 2.

On the bottom corners of the two leg portions 35 are arranged outwardly angled-off anchoring lugs 36 which engage matching transverse wall apertures (not shown) in the filter housing wall 1. The wall apertures for the anchoring lugs 36 differ from the apertures 19 of FIGS. 2 in that they have an elongated, shallow cross-sectional outline. Obviously, the anchoring lugs 36 could also extend inwardly from the leg portions 35 of the pivot anchor 33.

As FIG. 2 further indicates, the closed position of the knee lever lock is such that the fixed pivot axis 21 is located radially outside the force line which links the pressure point 27 between the peripheral bead 5 and the hook member 12 with the hook member pivot axis 24 on the knee lever 11. This means that when the lock is opened, the pivot axis 24 will move radially outwardly and also downwardly, until it reaches the dead-center position in which the earlier-mentioned force line coincides with the fixed pivot axis 21. The downward movement of the hook member pivot axis 24 requires a corresponding extension of the hook member 12, and the latter, having a spring bias against such extension, tends to pull the knee lever 11 in a clockwise direction, into abutment against the filter housing wall 1. The result of this arrangement is that the knee lever lock 10 is secured in its locked position, regardless of the orientation in which the lock is mounted. The spring action of the hook member 12 also gives the lock unit complete safety against vibration.

In the preferred embodiment which is shown in FIGS. 1 and 2, the yoke portion 14 of the pivot anchor is fully engaged in the groove formed by the inverted "U" of the housing rim 2. In this configuration, the yoke portion 14 is secured not only radially in both directions, but also axially, by abutting against the bottom of the groove. The result is a rigidly positioned pivot anchor 13 and a fixed pivot axis 21. However, it is also possible to provide for the pivot anchor 13 to undergo resilient deformation, when its yoke portion 14 is arranged at an axial distance from the housing rim 12. This allows the yoke portion 14 to shift axially along the housing wall 1, as the pivot axis 21 is displaced in relation to the transverse wall aperture 19 which holds the trunnions 16 of the pivot anchor 13. This spring action of the pivot anchor 13 adds itself to the spring action of the hook member 12.

It should be understood, of course, that the foregoing disclosure describes only preferred embodiments of the invention and that it is intended to cover all changes and modifications of these examples of the invention which fall within the scope of the appended claims.

We claim the following:

1. A knee lever lock for the creation of a quickly releasable clamping connection between two machine elements, as, for example, between the housing and the housing cover of the air intake filter of an automobile engine, the lock comprising in combination:

an elongated hook member having an attached extremity and a free extremity, the attached extremity being a pivot formation and the free extremity being a hook formation adapted to engage one of the two machine elements in the sense of pulling it in the direction of a force line which runs from the hook formation engagement point to the pivot formation of the attached extremity of the hook member;

an elongated knee lever having likewise an attached extremity and a free extremity, as well as an intermediate pivot formation engaged by the pivot formation of the attached extremity of the hook member, thereby forming a hook member pivot axis which is oriented transversely to said force line, the attached extremity of the knee lever being a pivot formation for a knee lever pivot axis which is parallel to the hook member pivot axis, and its free extremity being manually engageable for lock opening and closing displacements of the knee lever about its pivot axis;

a knee lever stop determining the position of the knee lever in the closed position of the lock; and a pivot anchor having a generally U-shaped outline comprising a yoke portion and two spaced leg portions, the leg portions having angled-off anchoring extremities which are adapted to be snapped into and retained by matching transverse apertures in an outside wall of the other one of the two machine elements, the pivot anchor further including aligned pivot formations in its leg portions, intermediate of their anchoring extremities and the yoke portion, said aligned pivot formations being engaged by the pivot formation of the attached knee lever extremity, thereby determining the location of the knee lever pivot axis, said location being longitudinally between the hook member pivot axis and the hook formation engagement point and at such a distance from the transverse wall apertures of said other machine element that, when the knee lever rests against the knee lever stop, in the closed position of the lock, said force line of the hook member extends between the hook member pivot axis and the transverse wall apertures.

2. A knee lever lock as defined in claim 1, wherein the pivot anchor includes an abutment formation adapted to engage the outside wall of said other machine element, at a distance from the transverse wall apertures and on the opposite side of the knee lever with respect to the knee lever pivot axis, so that the abutment formation supports the pivot anchor against the lock closing force which is generated by the knee lever and hook member.

3. A knee lever lock as defined in claim 2, wherein the pivot anchor is a wire part, its yoke portion serving as said abutment formation, its angled-off extremities being anchoring trunnions, extending in parallel alignment with the knee lever pivot axis, and the pivot formations in its leg portions being in the form of wire loops which define aligned pivot apertures in the knee lever pivot axis.

4. A knee lever lock as defined in claim 3, wherein the knee lever and the hook member are likewise wire parts having both a generally U-shaped outline comprising a yoke portion and two spaced leg portions;

the yoke portion of the knee lever is its manually engageable free extremity, the pivot formation of the attached extremity of the knee lever being in the form of angled-off, aligned pivot trunnions engaging said pivot apertures of the pivot anchor, and the intermediate pivot formation for the hook member pivot axis being in the form of wire loops in the knee lever leg portions which define aligned pivot apertures; and the yoke portion of the hook member is its hook formation, the pivot formation of the attached extremity of the hook member in the hook member pivot axis being in the form of angled-off, aligned pivot trunnions engaging said pivot apertures in the knee lever leg portions.

5. A knee lever lock as defined in claim 3, wherein the yoke portion of the pivot anchor, which serves as said abutment formation, is longitudinally slidable along the wall of said other machine element; and the leg portions of the pivot anchor are capable of resiliently yielding under the lock closing force which is exerted on said wire loops in the knee lever pivot axis by the knee lever and hook member, so as to permit a spring-action-opposed pivoting displacement of the knee lever pivot axis about the anchoring trunnions of the pivot anchor.

6. A knee lever lock as defined in claim 2, wherein the pivot anchor is a sheet metal stamping, its leg portions being in the form of two substantially parallel sheet metal panels, a corner portion of the panels serving as said abutment means;

the angled-off extremities of the pivot anchor are in the form of anchoring lugs extending in parallel alignment with the knee lever pivot axis; and the pivot formations in the leg portions of the pivot anchor are transverse bores defining the knee lever pivot axis.

* * * * *